US006032740A

United States Patent [19]

Schnitker et al.

[11] Patent Number: 6,032,740

[45] Date of Patent: Mar. 7, 2000

[54] HOOK MILL SYSTEMS

[75] Inventors: Mark W. Schnitker, Friendswood; Andre N. Broussard, Nassau Bay, both of Tex.; Jack Dunson, Farmington, N.Mex.; Patrick Williamson, Kingwood, Tex.

[73] Assignee: Weatherford/Lamb, Inc., Houston, Tex.

[21] Appl. No.: 09/012,337

[22] Filed: Jan. 23, 1998

[51] Int. Cl.[7] ..... E21B 7/08; E21B 29/06

[52] U.S. Cl. ..... 166/298; 166/117.5; 175/82

[58] Field of Search ..... 166/50, 55, 55.1, 166/117.5, 117.6, 298, 382; 175/79, 80, 81, 82

[56] References Cited

U.S. PATENT DOCUMENTS

| | | | |
|---|---|---|---|
| 2,807,440 | 9/1957 | Beck . | |
| 2,882,015 | 4/1959 | Beck . | |
| 3,908,759 | 9/1975 | Cagle et al. | 166/117.6 |
| 4,717,290 | 1/1988 | Reynolds et al. | 407/34 |
| 4,796,709 | 1/1989 | Lynde et al. | 166/55.6 |
| 4,938,291 | 7/1990 | Lynde et al. | 166/55.8 |
| 4,984,488 | 1/1991 | Lunde et al. | 166/55.6 |
| 5,014,778 | 5/1991 | Lynde et al. | 166/55.6 |
| 5,038,859 | 8/1991 | Lynde et al. | 166/55.6 |
| 5,058,666 | 10/1991 | Lynde et al. | 166/55.6 |
| 5,109,924 | 5/1992 | Jurgens et al. | 166/117.5 |
| 5,199,513 | 4/1993 | Stewart et al. | 175/73 |
| 5,297,630 | 3/1994 | Lynde et al. | 166/297 |
| 5,318,115 | 6/1994 | Rouse | 166/55.7 |
| 5,341,873 | 8/1994 | Carter et al. | 166/117.5 |
| 5,425,417 | 6/1995 | Carter | 166/117.6 |
| 5,425,419 | 6/1995 | Sieber | 166/206 |
| 5,429,187 | 7/1995 | Beagrie et al. | 166/555.1 |
| 5,431,220 | 7/1995 | Lennon et al. | 175/81 X |
| 5,443,129 | 8/1995 | Bailey et al. | 175/45 |
| 5,531,271 | 7/1996 | Carter | 166/117.6 |
| 5,535,822 | 7/1996 | Schock et al. | 166/50 |
| 5,678,634 | 10/1997 | Rehbock et al. | 166/377 |
| 5,720,349 | 2/1998 | Pleasants et al. | 166/298 |
| 5,771,972 | 6/1998 | Dewey et al. | 168/298 |
| 5,806,596 | 9/1998 | Hardy et al. | 166/298 |
| 5,816,324 | 10/1998 | Swearingen | 166/117.5 |
| 5,832,997 | 11/1998 | White et al. | 166/117.6 |

FOREIGN PATENT DOCUMENTS

| | | |
|---|---|---|
| 2 312 702 | 1/1997 | United Kingdom . |
| WO 94/09243 | 10/1993 | WIPO . |
| WO 97/27380 | 1/1997 | WIPO . |

OTHER PUBLICATIONS

Casing Whipstocks, Eastman Composite Catalog 1976–77, p. 2226.

Improved Casing Sidetrack Procedure Now Cuts Wider, Longer Windows, Petroleum Engr. Int'l, Mar. 1979.

Int'l Search Report in PCT/GB99/00078.

*Primary Examiner*—George Suchfield

*Attorney, Agent, or Firm*—Guy McClung

[57] ABSTRACT

A wellbore mill system having a first mill with a main body with a top end and a bottom end, milling structure on the main body, and a hook portion projecting from the bottom end of the main body for supporting at least one member below the first mill, the hook portion having a lip. One such system has a whipstock having a top lug, the top lug resting on the lip of the hook portion of the first mill, the top lug having a hole therethrough, the hook portion of the main body of the first mill having a hole therethrough, a shear stud with a portion extending through the hole in the top lug and a portion extending through the hole in the hook portion thereby releasably securing the first mill to the whipstock.

14 Claims, 3 Drawing Sheets

FIG. 7a
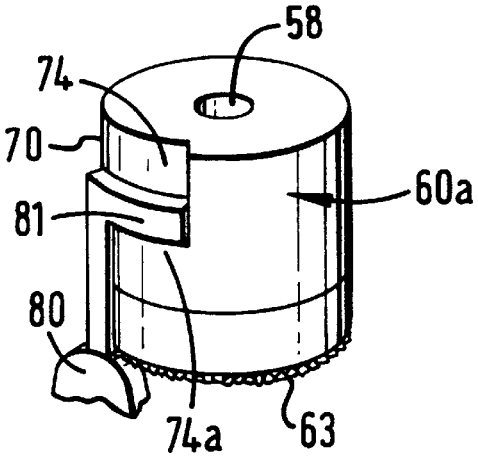
FIG. 7b
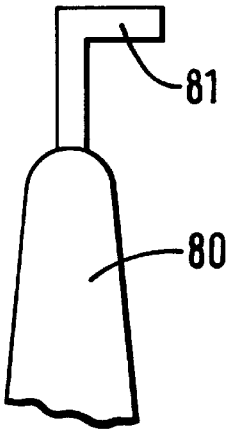
FIG. 7c
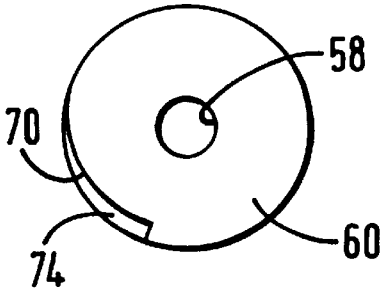
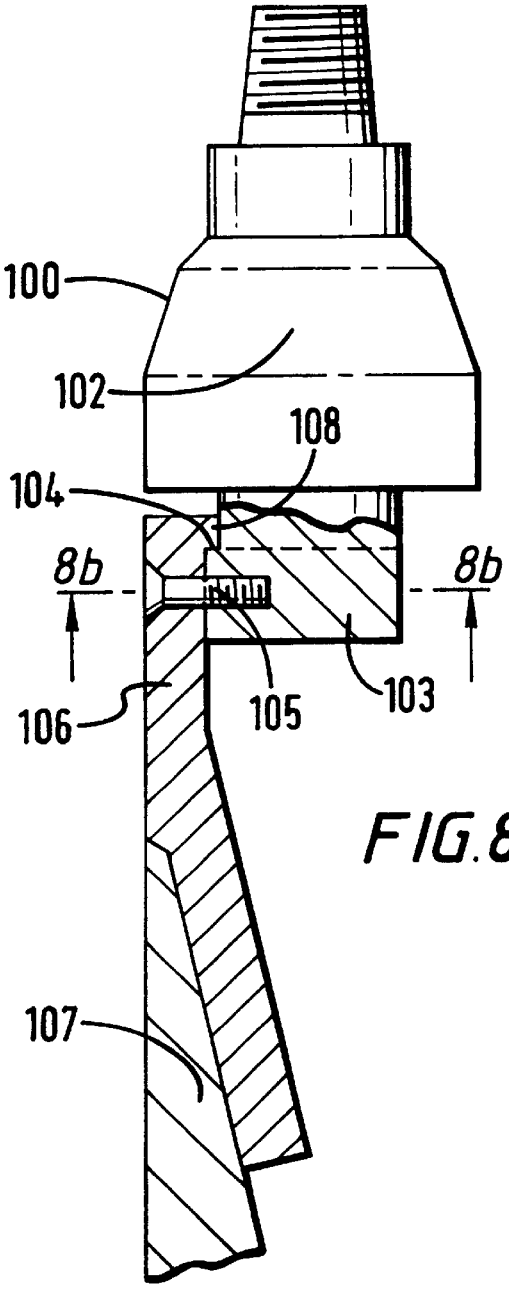
FIG. 8a
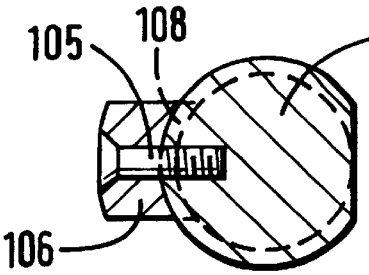
FIG. 8b

HOOK MILL SYSTEMS

BACKGROUND OF THE INVENTION

1. Field of the Invention

This invention is related to wellbore milling processes, milling systems, milling tools and whipstocks.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge adjacent or beneath the cutting blades. An upward flow of the discharged fluid in the annulus outside the tool removes cuttings or chips from the well resulting from the milling operation.

Prior art sidetracking methods employ a variety of wellbore mills, including, but not limited to, well known starting mills and window mills. A whipstock deflects a mill laterally while it is being moved downwardly in a well during rotation of the mill to cut an elongated opening pocket, or window in well casing.

Certain prior art well sidetracking operations which employ a whipstock also employ a variety of different mills and milling systems used in a certain sequence. This sequence of operation may require a plurality of "trips" into the wellbore. For example, in certain multi-trip operations, an anchor, slip mechanism, or an anchor-packer is set in a wellbore at a desired location. A whipstock-mill combination tool is then run into the wellbore by first properly orienting a stinger at the bottom of the tool with respect to a concave face of the tool's whipstock. Typically a starting mill or a window mill is releasably secured at the top of the whipstock, e.g. with a shearable member, e.g. a shearable screw or a setting stud and nut connected to a pilot lug on the whipstock. This setting stud bears the entire load of whatever is connected beneath the lowermost mill. The tool is then lowered into the wellbore oriented and anchored. Putting weight down on the tool then shears the setting stud, freeing the lowermost mill, e.g. a window mill or a starting mill from the tool. The mill is diverted into the casing and the casing is milled in some cases as the pilot lug is milled off. The mill moves downwardly while contacting the concave portion and cuts an initial window in the casing. If a starting mill is the lowermost mill, it is then removed from the wellbore. A window mill, e.g. on a flexible joint of drill pipe, is lowered into the wellbore and rotated to mill down from the initial window formed by the starting mill. Then additional mills may be used behind the window mill to lengthen and/or finish the casing window if desired.

There has long been a need for efficient and effective wellbore milling methods and systems in which a significant weight can be imposed on the system without inadvertent shearing of a shear stud connecting a mill to a whipstock, particularly in wellbore sidetracking procedures and the production of multiple lateral wellbores.

SUMMARY OF THE PRESENT INVENTION

The present invention, in one embodiment, discloses a mill with a main body which, in one aspect, has a central bore therethrough. In another aspect the mill is a window mill or a starting mill/window mill combination. Secured to or formed of the main body of the mill is a weight support surface or hook portion. Such a hook portion, in one aspect, is configured, sized, and disposed to underlie a typical whipstock lug so that the mill supports the whipstock and any item(s) connected to and below the whipstock. Thus the weight of the whipstock is isolated from a shear member or stud (or studs, in one aspect) that holds the mill to the whipstock. The shear stud remains shearable by an appropriate known downward force on the string that includes the mill at its lower end, the string extendable down into and/or extending from the earth surface down into a wellbore.

In another aspect, a mill body has thereon or therein a recess that includes a weight supporting surface. In one aspect the recess is configured to releasably hold a hook of a whipstock.

In one method according to the present invention a system including a starting mill with a hook portion as described above is included in a drill string run into a wellbore. A shear stud secures the starting mill to a lug at the top of a typical whipstock. The hook portion is at a lower end of a nose or lower projecting member extending down from the starting mill's main body. The whipstock may have connected and/or interconnected therebelow any or all or any combination of the following: an anchor, a packer, an anchor-packer, an orienting device, a plug, one or more tubulars, one or more spacers for repositioning the whipstock.

In one particular method, according to the present invention, the starting mill is used when it is desired to add one or more tubulars (e.g. drill collars, drill pipe, tubing), below a whipstock so that the whipstock, when run into the wellbore is positionable a known distance above a previously-cut opening in casing that cases the wellbore.

In certain wellbore milling operations (including, but not limited to certain "single-trip" operations) a series of two or more mills, in tandem and spaced-apart, are run into a wellbore in combination with a whipstock alone or with a whipstock and some type of anchoring mechanism. The lowermost mill of the series may have a hook portion as described above to isolate a shear stud from the load of the weight of all the items hanging below the lowermost mill. In one aspect, the lowermost mill is a window mill with the weight support surface or the hook portion.

It is, therefore, an object of at least certain preferred embodiments of the present invention to provide:

New, useful, unique, efficient, non-obvious milling methods and systems in which a significant load can be carried by a mill or mill system without inadvertently shearing a shear member or stud connecting the mill to a whipstock;

Such methods and systems in which a hook portion of a mill supports a whipstock and, in one aspect, one or more items and/or tubulars interconnected to and below the whipstock, the hook portion isolating the shear stud from the weight of the whipstock and additional items; and Such methods and systems in which the only mill or a lowermost mill of a multiple mill (two, three, or more) system is either a starting mill or a window mill.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 7*a* is a side perspective view of a window mill according to the present invention. FIG. 7*b* is a front view of a whipstock usable with the mill of FIG. 7*a*. FIG. 7*c* is a top view of the mill of FIG. 7*a*.

FIG. 8*a* is a side cross-sectional side view of a system according to the present invention. FIG. 8*b* is a cross-sectional view along line 8*b*—8*b* of FIG. 8*a*.

DESCRIPTION OF EMBODIMENTS PREFERRED AT THE TIME OF FILING FOR THIS PATENT

Figure 1:
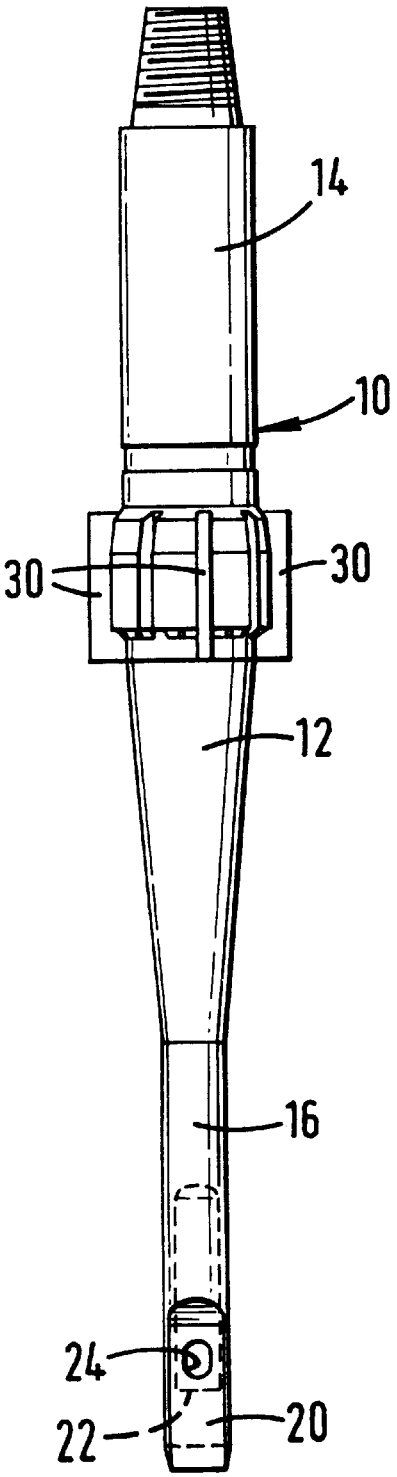
FIGS. 1, 3 and 4 are side views of a starting mill according to the present invention.
Figure 2:
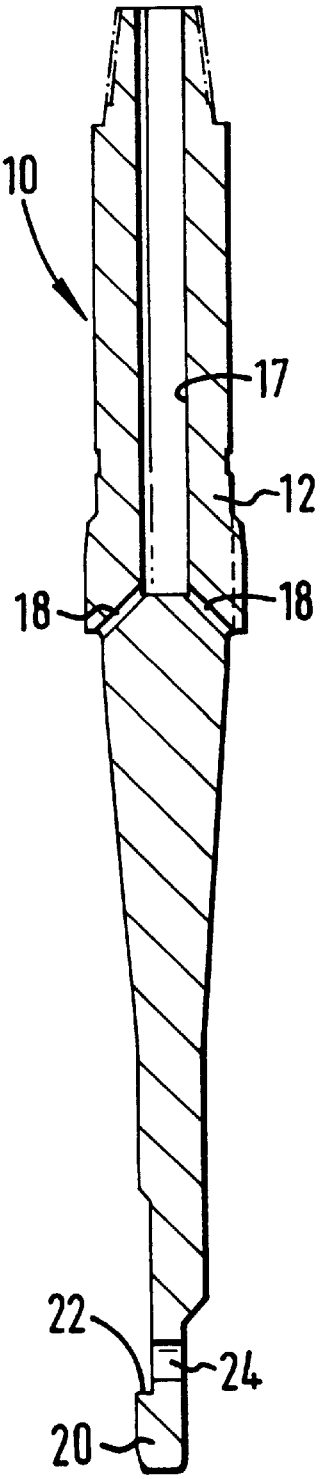
FIG. 2 is a cross-sectional side view of the starting mill of FIG. 1.

FIG. 1 shows a starting mill 10 according to the present invention with a main body 12 having a top 14 and a bottom 16 with a flow bore 17 therethrough extending from the top 14 to exhaust ports 18.

A lowered tapered part of the mill 10 ends in a hook portion 20 that has a lip 22 sized and configured for positioning below a top lug of a whipstock so that the lug can rest thereon, thereby allowing the whipstock to hang from the hook portion 20. A hole 24 through the bottom 16 of the mill 10 permits a shear stud to be emplaced through the mill 10 with part projecting into a corresponding hole in a whipstock lug.

Figure 3:
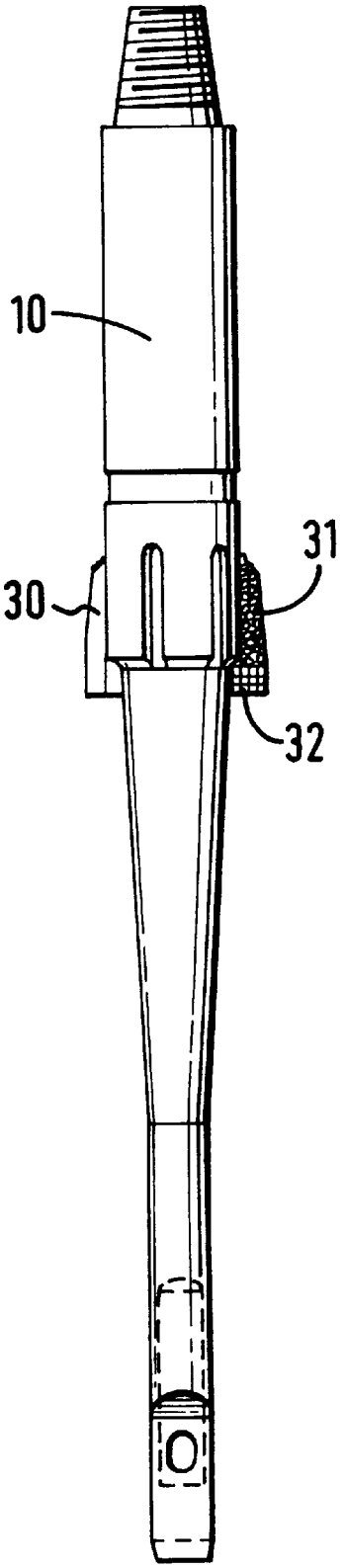
Figure 4:
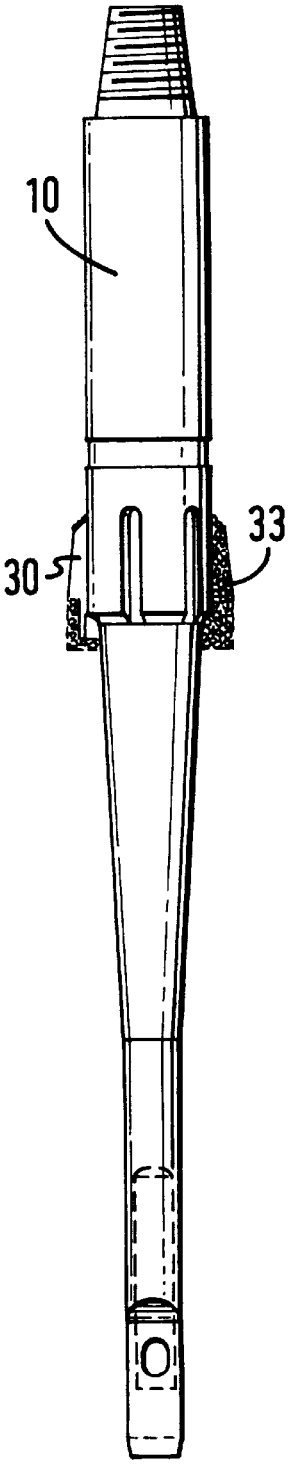

The mill 10 may include any known blade and/or milling matrix material to provide cutting action. In the embodiment shown in FIG. 1, a plurality of milling blades 30 are secured to or formed of the main body 12. In one aspect, the blades are dressed with matrix milling material (e.g. KUTRITE (tm) material); with milling inserts; or with both milling material and inserts in any known pattern, array, or combination. FIG. 3 shows the blades 30 dressed with matrix miling material 31 and with inserts 32. FIG. 4 shows the blades 30 dressed with matrix milling material 33.

Figure 5:
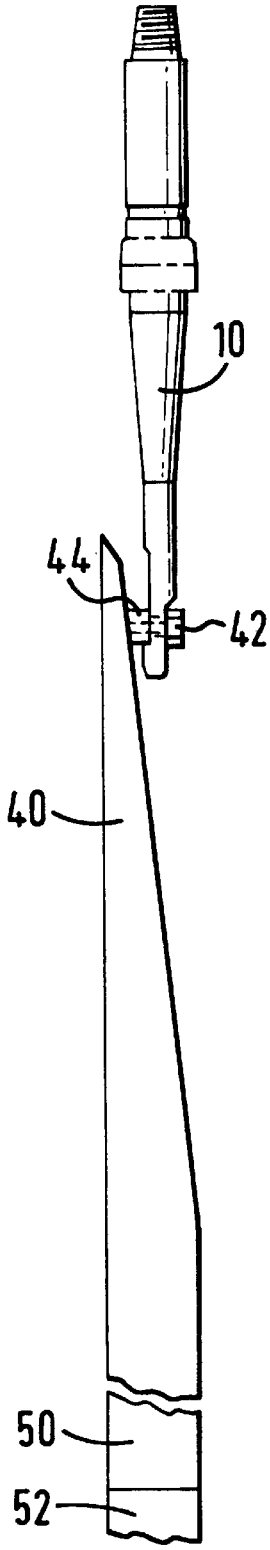
FIG. 5 is a side schematic view of a system according to the present invention.

FIG. 5 shows a starting mill (e.g. the mill 10) secured by a shear stud 42 to a lug 44 of a whipstock 40. Numeral 50 indicates schematically a whipstock anchor mechanism (e.g. anchor—hydraulically and/or mechanically settable, settable slip device, anchor-packer) and numeral 52 indicates schematically one or more tubulars secured below the anchor mechanism.

Although the mill in FIG. 5 is shown as a starting mill, it is within the scope of this invention for any mill, mill system, or mill-drill tool to have a hook portion as described above and be used with a whipstock as shown in FIG. 5.

Figure 6A:
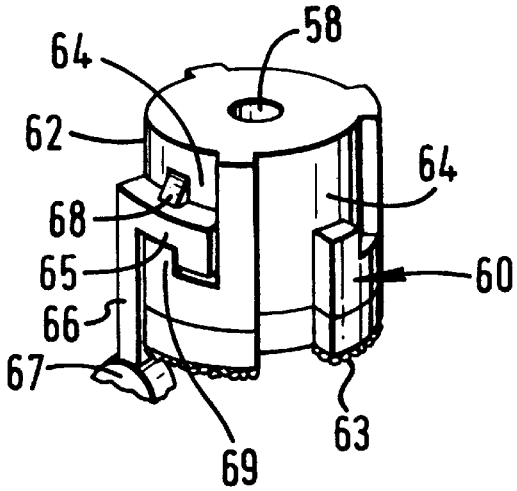
FIG. 6*a* is a side perspective view of a window mill according to the present invention.
Figure 6B:
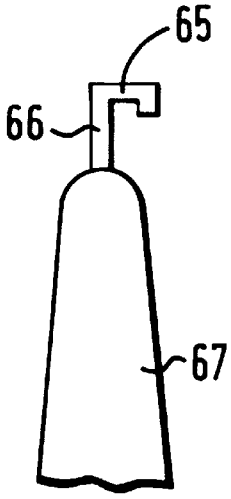
FIG. 6*b* is a front view of a whipstock usable with the mill of FIG. 6*a*.

FIG. 6*a* shows a window mill 60 with a body 62 and a milling end 63. At least one hook recess 64 is formed in the body 62 and, in one aspect as shown there are a plurality of such recesses spaced-apart around the mill body 62. A corresponding top hook portion 65 of a lug 66 of a whipstock 67 is releasably held in he recess 64. In one aspect an hydraulically actuable latch 68 projects movably and outwardly over the top of the top hook portion to releasably maintain the top hook portion in the recess.

FIG. 7*a* shows a window mill 60 with a hook recess 74 having a tapered end portion 70 so that mill rotation facilitates release of the top hook portion 81 of a whipstock 80 shown in FIG. 7*b*.

FIGS. 8*a* and 8*b* show a mill 100 according to the present invention with a body 102 and a pilot end 103 having a support shoulder 104. A shear stud 105 extends through a top lug 106 of a whipstock 107 into the pilot end 103 of the mill 100. the support shoulder 104 underlies a projecting portion 108 of the top lug 106 and thereby supports the whipstock 107 (and anything connected therebeneath). The mill body and milling surfaces of the mill 100 and/or of the pilot end 103 may be dressed with any known matrix milling material and/or inserts in any known arrangement, combination, array or pattern by any known method.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A wellbore mill system comprising a first mill with a main body with a top end and a bottom end, milling structure on the main body, and a hook portion projecting from the bottom end of the main body for supporting at least one member below the first mill, the hook portion having a lip.

2. The wellbore mill system of claim 1 further comprising a whipstock having a top lug, the top lug resting on the lip of the hook portion of the first mill, the top lug having a hole therethrough, the hook portion of the main body of the first mill having a hole therethrough, a shear stud with a portion extending through the hole in the top lug and a portion extending through the hole in the hook portion thereby releasably securing the first mill to the whipstock.

3. The wellbore mill system of claim 2 further comprising at least one additional wellbore apparatus connected to and below the whipstock.

4. The wellbore mill system of claim 3 wherein the at least one additional wellbore apparatus is at least one wellbore tubular member.

5. The wellbore mill system of claim 4 wherein the at least one wellbore tubular member is a plurality of wellbore tubular members.

6. The wellbore mill system of claim 3 wherein the at least one additional wellbore apparatus is a whipstock anchor mechanism.

7. The wellbore mill system of claim 1 wherein the first mill is a starting mill.

8. The wellbore mill system of claim 1 wherein the first mill is a window mill.

9. The wellbore mill system of claim 1 further comprising at least one additional mill connected to and above the first mill.

10. A method for moving a wellbore milling system into a wellbore extending down into the earth, the wellbore milling system including a first mill with a main body with a top end and a bottom end, milling structure on the main body, and a hook portion projecting from the bottom end of the main body for supporting at least one member below the first mill, the hook portion having a lip, a whipstock having a top lug, the top lug resting on the lip of the hook portion of the first mill, the top lug having a hole therethrough, the hook portion of the main body of the first mill having a hole therethrough, a shear stud with a portion extending through the hole in the top lug and a portion extending through the hole in the hook portion thereby releasably securing the first mill to the whipstock, the method comprising securing the whipstock to the first mill with a shear stud, positioning the whipstock so that the top lug rests on the hook portion of the mill, introducing the mill and whipstock into the wellbore, and moving the mill and whipstock down into the wellbore.

11. The method of claim 10 wherein there is at least one additional wellbore apparatus connected to and below the whipstock.

12. The method of claim 11 wherein the at least one additional wellbore apparatus includes at least one additional mill.

13. the method of claim 10 wherein the milling system mills an opening in a tubular in the wellbore in a single trip into and out of the wellbore.

14. A whipstock for wellbore operations, the whipstock comprising a body with a diverting structure thereon for diverting a mill in a wellbore, a hook portion at the top of the body for releasably holding the whipstock to a mill postioned above the whipstock, a shearable member holding the mill to the whipstock, and the hook portion and mill disposed so that the mill bears the weight of the whipstock and the shearable member is isolated from said weight.

* * * * *